US009504342B2

(12) United States Patent
Chan et al.

(10) Patent No.: US 9,504,342 B2
(45) Date of Patent: Nov. 29, 2016

(54) CLOSURE ASSEMBLY FOR A DRINKING CUP

(71) Applicant: KONINKLIJKE PHILIPS N.V., Eindhoven (NL)

(72) Inventors: Young Ming Chan, Hong Kong (CN); Wai Ho Li, Hong Kong (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/358,910

(22) PCT Filed: Nov. 9, 2012

(86) PCT No.: PCT/IB2012/056277
§ 371 (c)(1),
(2) Date: May 16, 2014

(87) PCT Pub. No.: WO2013/072822
PCT Pub. Date: May 23, 2013

(65) Prior Publication Data

US 2014/0305945 A1 Oct. 16, 2014

Related U.S. Application Data

(60) Provisional application No. 61/561,958, filed on Nov. 21, 2011.

(30) Foreign Application Priority Data

Nov. 17, 2011 (EP) ..... 11189584

(51) Int. Cl.
*B65D 83/10* (2006.01)
*A47G 19/22* (2006.01)

(52) U.S. Cl.
CPC ..... *A47G 19/2272* (2013.01)

(58) Field of Classification Search
CPC ..... A47G 19/2272
USPC ..... 220/361, 203.01, 203.07, 203.1, 220/203.11, 203.18, 203.23, 203.25, 253, 220/265, 260, 262, 281; 206/361; 215/11.4, 215/11.5, 18, 19
See application file for complete search history.

(56) References Cited

U.S. PATENT DOCUMENTS 3,015,411 A * 1/1962 Smith ..... A47G 19/2272 220/714
3,727,808 A * 4/1973 Fitzgerald ..... B65D 47/248 220/715

(Continued)

FOREIGN PATENT DOCUMENTS

EP 2138075 A1 12/2009
WO 0022969 A1 4/2000

(Continued)

*Primary Examiner* — Anthony Stashick
*Assistant Examiner* — James M Van Buskirk

(57) ABSTRACT

A closure assembly for a drinking cup includes an annular body, with a rim for drinking, mountable to a cup. A closure member, having apertures, is disposed within the body and extends across the cup. A sealing element, on an inner side of the closure member, and an actuator, on the opposite side of the closure member, are coupled to each other with the sealing element biased into a rest position in which it is urged against the inner side of the closure member to block the apertures and prevent liquid flow therethrough. The sealing element moves out of the rest position to allow liquid flow through the apertures when pressure sufficient to overcome the bias is applied to the actuator. The closure member includes a diaphragm that is integrally formed with a biasing member to bias the sealing element into the rest position.

12 Claims, 4 Drawing Sheets

(56) References Cited

U.S. PATENT DOCUMENTS

| | | | | |
|---|---|---|---|---|
| 4,184,603 | A | 1/1980 | Hamilton, Sr. | |
| 6,202,877 | B1 * | 3/2001 | La Torre ..... | A47G 19/2272 220/254.1 |
| 6,783,020 | B2 | 8/2004 | Featherston et al. | |
| 7,549,556 | B2 | 6/2009 | Miller | |
| 2004/0094552 | A1 | 5/2004 | Featherson et al. | |
| 2004/0232154 | A1 | 11/2004 | Smith et al. | |
| 2005/0224495 | A1 | 10/2005 | Kartinian | |
| 2009/0250461 | A1 | 10/2009 | Syrkos | |
| 2010/0237078 | A1 | 9/2010 | Lentz | |
| 2011/0101008 | A1 | 5/2011 | Draganic, III | |

FOREIGN PATENT DOCUMENTS

| | | | |
|---|---|---|---|
| WO | WO 2009156470 | A1 * | 12/2009 |
| WO | 2011020501 | A1 | 2/2011 |

* cited by examiner

CLOSURE ASSEMBLY FOR A DRINKING CUP

CROSS-REFERENCE TO PRIOR APPLICATIONS

This application is the U.S. National Phase application under 35 U.S.C. §371 of International Application No. PCT/IB2012/056277, filed on Nov. 9, 2012, which claims the benefit of U.S. Provisional Patent Application No. 61/561,958, filed Nov. 21, 2011 and European Patent Application No. 11189584.3, filed on Nov. 21, 2011. These applications are hereby incorporated by reference herein.

FIELD OF THE INVENTION

This invention relates to a closure assembly for a drinking cup for children or toddlers to help them develop the skills needed to drink from a conventional cup, whilst still being spill proof.

BACKGROUND TO THE INVENTION

Non-spill drinking cups are known and are generally aimed at young children or the infirm who may drop or otherwise spill the contents of an ordinary cup. Many conventional non-spill cups include a closure assembly that incorporate a valve which deforms or moves in response to the generation of a pressure difference across the valve to allow liquid to flow through the valve and out of the cup when a child sucks on a spout. When a child ceases to suck on the spout, the pressure difference is no longer present and so the valve closes to block further flow through the valve, thereby preventing spillage when the cup is dropped, inverted or shaken.

A problem with known non-spill cups is that they do not mimic the technique that is required to drink from an ordinary cup. Therefore the transition to drinking from a conventional non-spill cup to an ordinary cup can be difficult for many children.

In view of the foregoing, it is desirable to provide a non-spill cup for use by children that is used in a similar way to an ordinary cup and in which the user places the rim of the cup to their mouth and tips or inverts it so that fluid flows out of the cup and into their mouth under gravity, and without any need to generate a pressure differential by sucking.

It is known from U.S. Pat. No. 6,783,020 to provide a toddler drinking vessel. Although the user does not need to suck in order to take a drink from the vessel, they must manually move a lid between open and closed positions to permit and prevent, respectively, the flow of fluid out of the cup. A disadvantage with this cup is that if a user forgets to close the lid after drinking, the contents will be spilt if the cup is knocked over or inverted. Furthermore, a child might not have the strength or ability to manipulate the lid between its open and closed positions each time a drink is required.

Another drinking vessel is disclosed in U.S. Pat. No. 7,549,556 B2. Although this cup enables a user to drink from a rim, as with an ordinary cup, it still requires the child to suck in order to open a sealing piece and allow the liquid to flow. Therefore, it does not provide the child with adequate training on how to drink from a conventional cup.

EP 2 138 075 A1 discloses a lid for a liquid container which is used to substantially seal the container. The lid comprises a mounting frame for mounting the lid to the container, the frame having at least one passage opening for passage of the liquid in the container. Furthermore, the lid comprises a valve portion for closing the at least one passage opening of the mounting frame, a lip-operable operating portion for operating the valve portion, and spring means for urging the valve portion to a closing position, in which the at least one passage opening in the mounting frame is closed. The lid is especially intended to be used in combination with a cup filled with hot liquid, so that injuries of a child who tries to grab the cup can be avoided.

SUMMARY OF THE INVENTION

The present invention seeks to provide a closure assembly for a drinking cup that overcomes or substantially alleviates the problems with known cups, such as those described above.

According to the invention, there is provided a closure assembly for a drinking cup, comprising: an annular body mountable to an open upper end of a cup and having a rim to enable a user to drink liquid from said cup through the annular body, a closure member within said body positionable so as to extend across the open upper end of the cup to which the body is mounted and having a plurality of apertures therein, a sealing element on an inner side of the closure member and an actuator on the opposite side of the closure member which is accessible to a user when said closure assembly is mounted to a cup, the sealing element and actuator being coupled to each other with the sealing element biased into a rest position in which it is urged against said inner side of the closure member to block said apertures and prevent the flow of liquid therethrough, the arrangement being such that the sealing element is moved out of said rest position to allow liquid to flow through said apertures and out of the vessel when pressure sufficient to overcome said bias is applied to the actuator by a user, and a biasing member to bias the sealing element into its rest position, wherein the closure member comprises a deformable diaphragm, and wherein the biasing member is integrally formed with said deformable diaphragm. The closure assembly of the invention is configured so that a valve is opened in response to the application of pressure to an actuator. The pressure occurs as a result of applying a cup to which the closure assembly is attached, to the lips of a user in a normal drinking action.

A biasing member acts to bias the sealing element into a rest position. In particular, the closure member comprises a deformable diaphragm and the biasing member is integrally formed with said deformable diaphragm. An advantage of using a deformable diaphragm is that the entire closure member may deflect, in addition to the biasing member, so that when pressure is applied to the lip contacting portion the diaphragm may deflect in more than one direction, allowing fluid to flow out of the cup.

Preferably, the actuator comprises a lip contacting portion that extends over the closure member towards said rim on the annular body, wherein the closure member has a central opening, and wherein the deformable diaphragm has a raised region surrounding the central opening that spaces the lip contacting portion from the apertures, said biasing member being formed from said raised region surrounding the central opening. An advantage of this embodiment is that the biasing member is incorporated into the diaphragm, reducing the complexity and number of parts required.

In a preferred embodiment said lip contacting portion is spaced from the apertures in said closure member to form a fluid flow path between said apertures and the rim. This allows fluid to flow from the apertures in the closure member to the rim and, consequently, into the user's mouth.

The lip contacting portion may be configured such that, when a user places their upper lip over the rim to take a drink, their upper lip applies pressure to the lip contacting portion sufficient to overcome said bias to move the sealing element out of its rest position. This has the advantage that no additional action needs to be taken by a user, other than the action that would be taken in order to drink from a conventional open-ended cup. It therefore teaches a child how to drink from a conventional cup while retaining the spill proof features of other child cups.

In one embodiment the actuator and sealing element each comprise cooperating connecting elements to rigidly connect the actuator and sealing element to each other with the closure member therebetween. This allows the sealing element and actuator to be separated from the closure member, thereby allowing replacement and proper cleaning of each of these components.

As mentioned in the foregoing, the closure member may have a central opening. In such a case, said cooperating connecting elements may cooperate with each other through said opening.

In one embodiment the lip contacting portion is disc-shaped and said cooperating connecting element extends axially from said disc-shaped lip contacting portion through the central opening in the closure member.

As the lip contacting portion is disc-shaped and extends towards the rim of the annular body of the closure member without making contact with it, an annular opening is formed in the body between the rim and the lip contacting portion. A user may drink from any region around the rim and does not need to rotate the cup or closure member prior to placing the rim to their lips. Again, this mimics drinking from an ordinary cup.

In a preferred embodiment, the biasing member extends between the opposite side of the closure member and an underside of the lip contacting portion in a region surrounding said cooperating connecting element.

In a preferred embodiment, the annular body comprises a radially inwardly protruding shoulder and the closure member has a peripheral seat that is trapped between said shoulder and an upper edge of the cup when the body is mounted thereon, to form a seal between said peripheral seat and the upper edge. This releasably couples the closure member to the upper edge of the cup and prevents leakage around the outside of the closure member.

Preferably, the annular body has a threaded connecting portion for cooperation with a corresponding thread adjacent to the upper edge of a cup to mount said body on said cup.

According to another aspect, there is also provided a non-spill drinking vessel comprising a cup and a closure assembly according to the invention.

BRIEF DESCRIPTION OF THE DRAWINGS

Preferred embodiments of the invention will now be described, by way of example only, with reference to the accompanying drawings, in which.

DETAILED DESCRIPTION OF THE PREFERRED EMBODIMENTS

Figure 1:
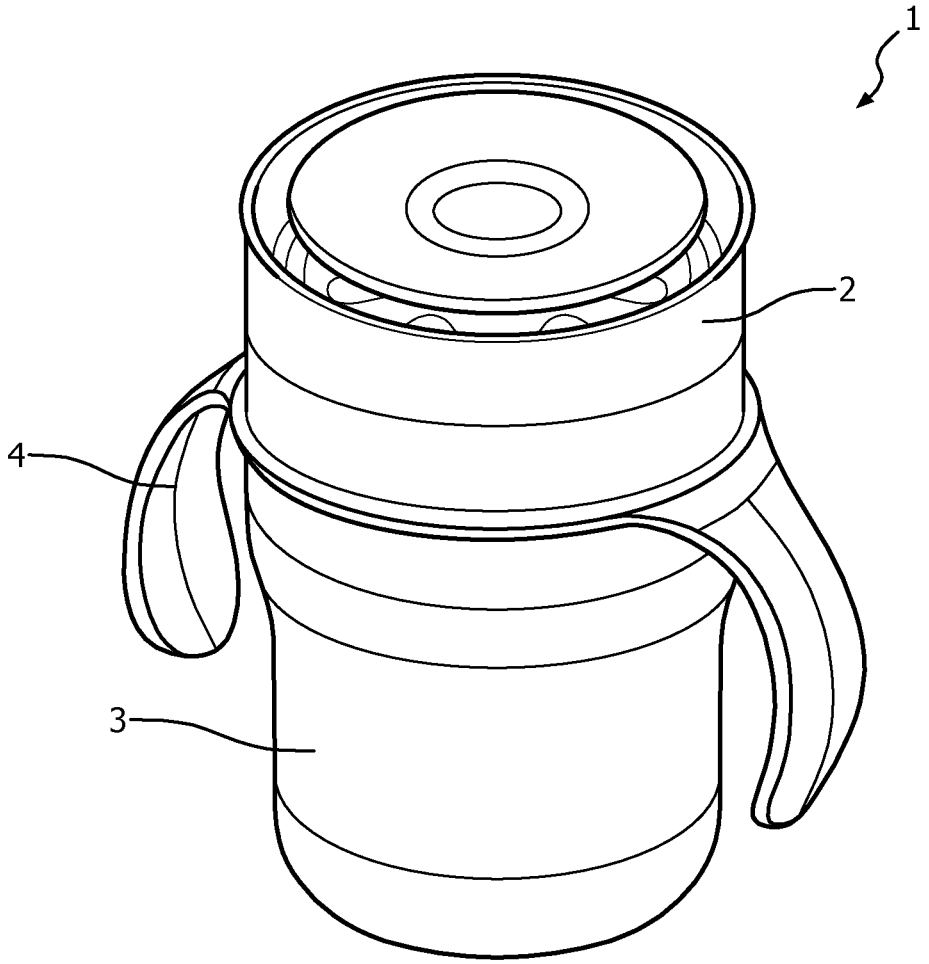
FIG. 1 shows a perspective view of a cup with a closure assembly mounted thereon.

Referring to the drawings, FIG. 1 shows a cup 3 having a closure assembly 2 mounted over its open upper end and a handle 4 extending from the cup 3. Although the handle 4 may be integrally formed with either the cup 3 or the closure assembly 2, it can also be a separate component that attached to the cup 3 or closure assembly 2 prior to mounting of the closure assembly 2 on the cup 3.

Figure 2:
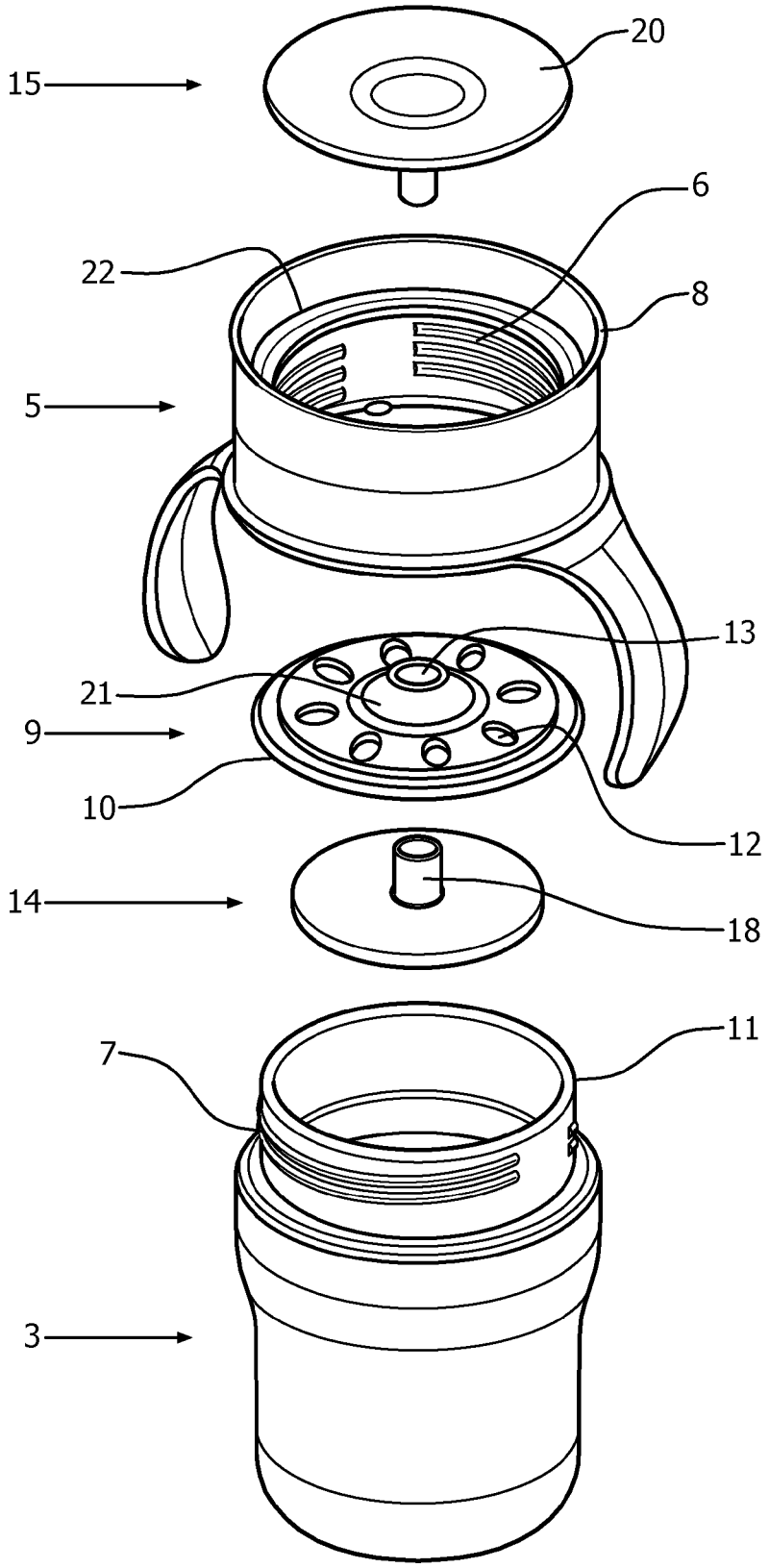
FIG. 2 shows an exploded perspective view of the cup and the closure assembly shown in FIG. 1.

FIG. 2 shows an exploded view of the cup and closure assembly 1. The closure assembly 2 comprises an annular body 5, the lower end of which is provided with an internal screw thread 6 to threadingly engage with a corresponding screw thread 7 on the cup 3 to removably mount the closure assembly 2 to the cup 3. The opposite, upper end, of the annular body 5 defines a rim 8 or edge that may be placed between the lips of a user to enable them to drink from the cup 3 through the annular body 5 when inverted or tipped-up into a position in which fluid will flow out of the cup 3.

The closure assembly 2 includes a closure member 9 that extends across the open upper end of the cup 3 and the annular body 5 includes a radially inwardly extending shoulder 22 that faces the upper edge 11 of the cup 3 when the annular body 5 is mounted thereon and sandwiches a peripheral edge 10 of the closure member 9 between the upper edge 11 of the cup 3 and the shoulder 22 when the annular body 5 is screwed onto the top of the cup 3, to prevent flow of fluid around the periphery of the closure member 9.

The closure member 9 has a plurality of fluid flow apertures 12 extending therethrough and a central aperture 13 to receive and mount a sealing element 14 facing an inner side of the closure member 9 and an actuator 15 on the opposite side of the closure member 9. The sealing element 14 and actuator 15 each have cooperating connecting portions that extend through said central aperture 13 and cooperate with each other so as to rigidly connect the sealing element 14 and actuator 15 together with the closure member 9 sandwiched between them.

In one embodiment, the cooperating connecting portion on the actuator 15 comprises a plug 17 that is received in a socket 18 that upstands from the centre of the sealing element 14. The plug 17 has a groove 19 or depression into which snap fits a complementary ring 23 on the socket to firmly engage the actuator 15 and sealing member 14 with each other. However, it will be appreciated that any other type of connection between the actuator 15 and sealing element 14 may be used. For example, the sealing element 14 and actuator 15 may each have cooperating threads that engage to connect them together with the closure member 9 located therebetween.

The actuator 15 has a disc-shaped lip contacting portion 20 that extends radially from its connecting portion 17 towards the rim 8 of the annular body 5. The lip contacting portion 20 is spaced from the apertures 12 in the closure member 9 to form a fluid flow path between the aperture 12 and the rim 8 of the annular body 5 by a biasing member that urges the lip contacting portion 20 away from the upper surface of the closure member 9 and draws the sealing element 14 into sealing engagement against the inner side of the closure member 9, thereby blocking the apertures 12 in the closure member 9 and preventing the flow of fluid therethrough.

According to the invention, the closure member 9 is a diaphragm and is formed from a flexible, resilient material. The biasing member is integrally formed with the diaphragm 9 and comprises a conical wall portion 21 surrounding the central aperture 13 and extending upwardly from the upper surface of the diaphragm 9 towards the underside of the lip contacting portion 20 of the actuator 15.

Figure 3:
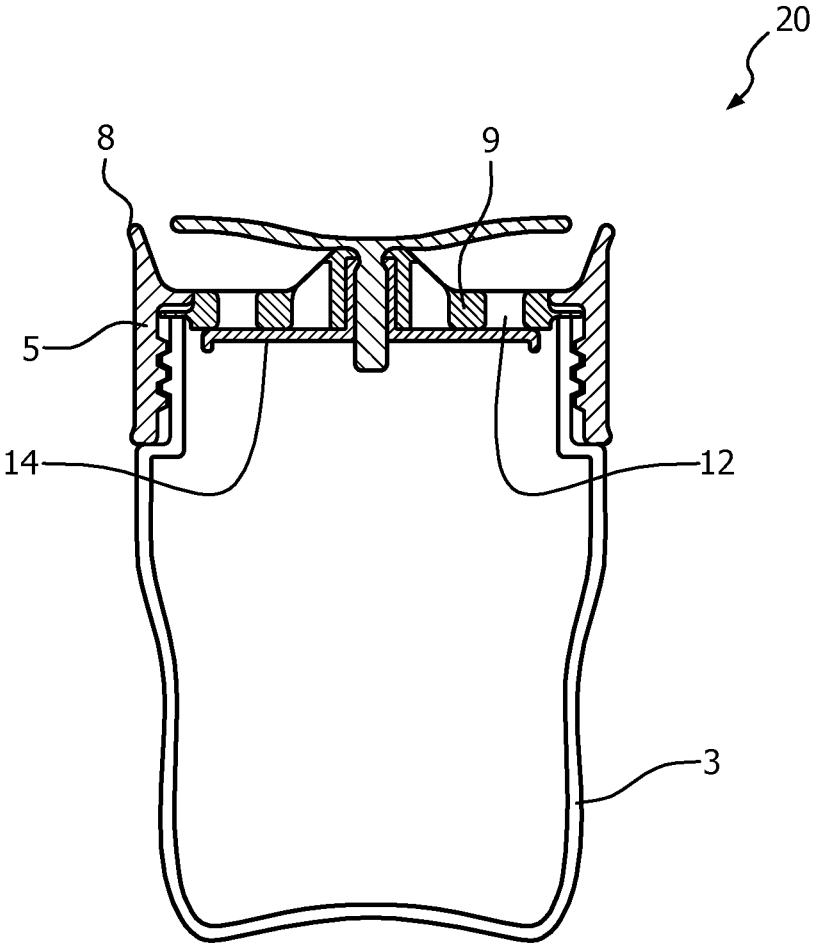
FIG. 3 shows a sectional side view of the closure assembly and cup shown in FIGS. 1 and 2.
Figure 4:
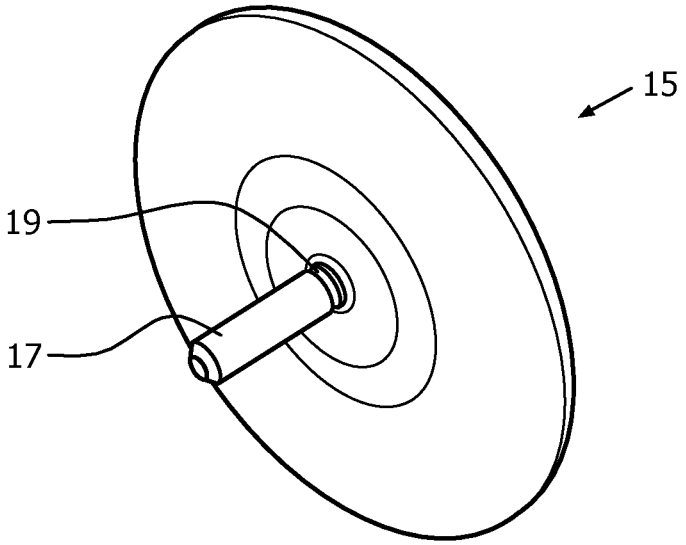
FIG. 4 shows an underside perspective view of the actuator.
Figure 5:
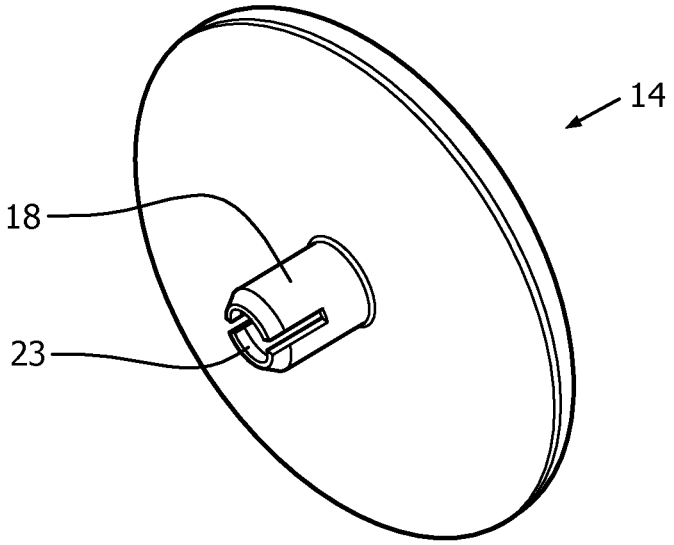
FIG. 5 shows an underside perspective view of the sealing disc.

As can be seen from FIGS. 1 and 3, the lip contacting portion 20 extends towards, but does not meet, the rim 8 of the annular body 5 so as to form an annular gap between the lip contacting portion 20 and the rim 8 so that liquid will flow over the rim 8 and into the mouth of a user when the sealing element 14 is moved into a position in which the apertures 12 in the closure member 9 are unblocked.

When a user places the rim 8 of the annular body 5 to their lips and inverts the cup 3 into a drinking position, their upper lip will contact the lip contacting portion 20 of the actuator 15 and apply pressure to it. The biasing member 21 is configured so that the pressure applied to the lip contacting portion 20 will overcome the bias generated by the biasing member 21 and so the wall will deform to allow the lip contacting portion 20 to be pushed downwardly further into the annular body 5 against the bias. As the sealing element 14 is rigidly coupled to the actuator 15, the sealing element 14 also moves relative to the closure member 9 away from its inner surface and unblocks the apertures 12 in the closure member 9, allowing fluid to pass through the apertures 12 and into the mouth of a user via the flow path beneath the lip contacting portion 20 and the annular gap between the lip contacting portion 20 and the rim 8 of the annular body 5.

When a user stops drinking from the cup 3 and the pressure applied to the actuator 15 is removed, the biasing member 21 urges the actuator 15 and the sealing member 14 back into their original positions, with the sealing member 14 urged against the inner surface of the closure member 9.

It will be appreciated that the term "comprising" does not exclude other elements and that the indefinite article "a" or "an" does not exclude a plurality. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

Other modifications and variations falling within the scope of the claims hereinafter will be evident to those skilled in the art.

The invention claimed is:

1. A closure assembly for a drinking cup, comprising:

an annular body mountable to an open upper end of a cup and having a rim to enable a user to drink liquid from said cup through the annular body;

a closure member within said annular body positionable so as to extend across the open upper end of the cup to which the annular body is mounted and having a plurality of apertures and a central opening, therein;

a sealing element positioned on an inner side of the closure member and comprising a socket extending in a first direction from the sealing element and toward the closure member;

an actuator positioned on an opposite side of the closure member opposite the inner side and comprising a plug extending in a second direction opposite the first direction from the actuator and toward the closure member which is accessible to the user when said closure assembly is mounted to the cup, wherein the sealing element and the actuator are coupled to each other, wherein a portion of the plug is positioned through the closure member and within the socket, with the sealing element biased into a rest position in which it is urged against said inner side of the closure member, and contacts said inner side with an upper side of the sealing element, which in the rest position runs parallel to the closure member, to block said apertures and prevent the flow of liquid therethrough, wherein the actuator comprises a lip contacting portion that extends over the closure member towards said rim on the annular body, the arrangement being such that the sealing element is moved out of said rest position to allow liquid to flow through said apertures and out of the cup when pressure sufficient to overcome said bias is applied to the lip contacting portion by the user; and a biasing member to bias the sealing element into the rest position, wherein the closure member comprises a deformable diaphragm, wherein the biasing member is integrally formed with said deformable diaphragm, and wherein the deformable diaphragm has a raised region surrounding the central opening that spaces the lip contacting portion from the apertures, said biasing member being formed from said raised region surrounding the central opening, wherein the central opening is formed through the raised region.

2. The closure assembly according to claim 1, wherein said lip contacting portion is spaced from the apertures in said closure member to form a fluid flow path between said apertures and the rim.

3. The closure assembly according to claim 1, wherein said lip contacting portion is configured such that, when the user places their upper lip over the rim to take a drink, their upper lip applies pressure to the lip contacting portion sufficient to overcome said bias to move the sealing element out of its rest position.

4. The closure assembly according to claim 1, wherein the actuator and the sealing element each comprise a cooperating connecting element to rigidly connect the actuator and the sealing element to each other with the closure member therebetween.

5. The closure assembly according to claim 4, wherein said cooperating connecting elements cooperate with each other through the central opening in the closure member.

6. The closure assembly according to claim 4, wherein the lip contacting portion of the actuator is disc-shaped and said cooperating connecting element of the actuator extends axially from said disc-shaped lip contacting portion through the central opening in the closure member.

7. The closure assembly according to claim 4, wherein the biasing member extends between the opposite side of the closure member and an underside of the lip contacting portion in a region surrounding said cooperating connecting elements.

8. The closure assembly according to claim 1, wherein the annular body comprises a radially inwardly protruding shoulder and the closure member has a peripheral seat that is trapped between said shoulder and an upper edge of the cup when the annular body is mounted thereon, to form a seal between said peripheral seat and the upper edge.

9. The closure assembly according to claim 1, wherein said annular body has a threaded connecting portion for cooperation with a corresponding thread adjacent to an upper edge of the cup to mount said annular body on said cup.

10. A non-spill drinking vessel, comprising a cup; and a closure assembly comprising:

an annular body mountable to an open upper end of the cup and having a rim to enable a user to drink liquid from said cup through the annular body;

a closure member within said annular body positionable so as to extend across the open upper end of the cup to which the annular body is mounted and having a plurality of apertures and a central opening therein;

a sealing element positioned on an inner side of the closure member and comprising a socket extending in a first direction from the sealing element and toward the closure member;

an actuator positioned on an opposite side of the closure member opposite the inner side and comprising a plug extending in a second direction opposite the first direction from the actuator and toward the closure member which is accessible to the user when said closure assembly is mounted to the cup, wherein the sealing element and the actuator are coupled to each other, wherein a portion of the plug is positioned through the closure member and within the socket, with the sealing element biased into a rest position in which it is urged against said inner side of the closure member, and contacts said inner side with an upper side of the sealing element, which in the rest position runs parallel to the closure member, to block said apertures and prevent the flow of liquid therethrough, wherein the actuator comprises a lip contacting portion that extends over the closure member towards said rim on the annular body, the arrangement being such that the sealing element is moved out of said rest position to allow liquid to flow through said apertures and out of the cup when pressure sufficient to overcome said bias is applied to the lip contacting portion by the user; and a biasing member to bias the sealing element into the rest position, wherein the closure member comprises a deformable diaphragm, wherein the biasing member is integrally formed with said deformable diaphragm, and wherein the deformable diaphragm has a raised region surrounding the central opening that spaces the lip contacting portion from the apertures, said biasing member being formed from said raised region surrounding the central opening, wherein the central opening is formed through the raised region.

11. The closure assembly according to claim 1, wherein the annular body comprises an inner surface with an internal screw thread.

12. The non-spill drinking vessel according to claim 10, wherein the annular body comprises an inner surface with an internal screw thread.

* * * * *